United States Patent [19]

Briggs

[11] 4,027,443

[45] June 7, 1977

[54] FIRE AND IMPACT RESISTANT WINDOW ASSEMBLY

[75] Inventor: Robert L. Briggs, Anaheim, Calif.

[73] Assignee: Aneomstat Products Division, Dynamics Corporation of America, Scranton, Pa.

[22] Filed: Oct. 14, 1975

[21] Appl. No.: 621,664

[52] U.S. Cl. ..... 52/202; 52/106; 52/304; 52/307; 52/398; 52/616; 428/34; 156/109

[51] Int. Cl.² ..... E04C 2/54; E06B 3/26

[58] Field of Search .... 52/106, 202, 203, 304–308, 52/397–401, 616, 172; 156/109; 428/34, 412, 426

[56] References Cited

UNITED STATES PATENTS

| | | | |
|---|---|---|---|
| 621,542 | 3/1899 | Sheppard | 52/398 |
| 1,792,550 | 2/1931 | Pettit | 52/616 |
| 2,080,394 | 5/1937 | Ballantyne | 52/202 |
| 2,118,643 | 5/1938 | Fox | 52/307 |
| 2,308,918 | 1/1943 | Hertel et al. | 52/401 |
| 2,612,154 | 9/1952 | Mills | 52/616 |
| 2,659,686 | 11/1953 | Watkins | 52/616 |
| 2,883,718 | 4/1959 | Persson | 52/398 |
| 3,630,814 | 12/1971 | Arnold | 52/616 |

*Primary Examiner*—Price C. Faw, Jr.
*Assistant Examiner*—James L. Ridgill, Jr.
*Attorney, Agent, or Firm*—McCormick, Paulding & Huber

[57] ABSTRACT

A fire and impact resistant window assembly comprising a multi-part centrally open marginal frame having an intermediate or inner groove which faces inwardly and first and second outer grooves which also face inwardly. The intermediate or inner groove receives marginal portions of a pane of fire glass which is thus secured in the frame and extends across the central opening thereof. The outer grooves respectively receive marginal portions of first and second panes of deflectable impact resistant polycarbonate and thus secure the panes in opposite spaced relationship with the fire glass. One pane of polycarbonate is approximately one half (½) inch in thickness and is spaced from the fire glass a distance of 0.35 inches. The other pane of polycarbonate is approximately one fourth (¼) inch in thickness and is spaced from the fire glass a distance somewhat in excess of 0.35 inches. Impact loading as severe as a 44 magnum fired from a distance of 4 feet is thus accommodated on the one half (½) inch polycarbonate side.

4 Claims, 3 Drawing Figures

FIRE AND IMPACT RESISTANT WINDOW ASSEMBLY

BACKGROUND OF THE INVENTION

Window assemblies having fire glass panes of the embedded wire type have heretofore been employed for various uses including applications in penal and other institutions. Such window assemblies are generally satisfactory, but certain problems are encountered in use. For example, inmates may hit their heads against the wire glass causing the glass to shatter and resulting in injury to the inmates and rendering the glass useless or substantially useless as a fire stop. Other forms of impact loading may of course also occur as in the impingement of hard objects on the panes including fire arm projectiles.

SUMMARY OF THE INVENTION

It is the general object of the present invention to provide a window assembly which is both fire and impact resistant, which is dependable and durable in use, and which yet exhibits a high degree of simplicity in construction so as to be manufactured at economic advantage.

DETAILED DESCRIPTION OF THE PREFERRED EMBODIMENT

Figure 1:
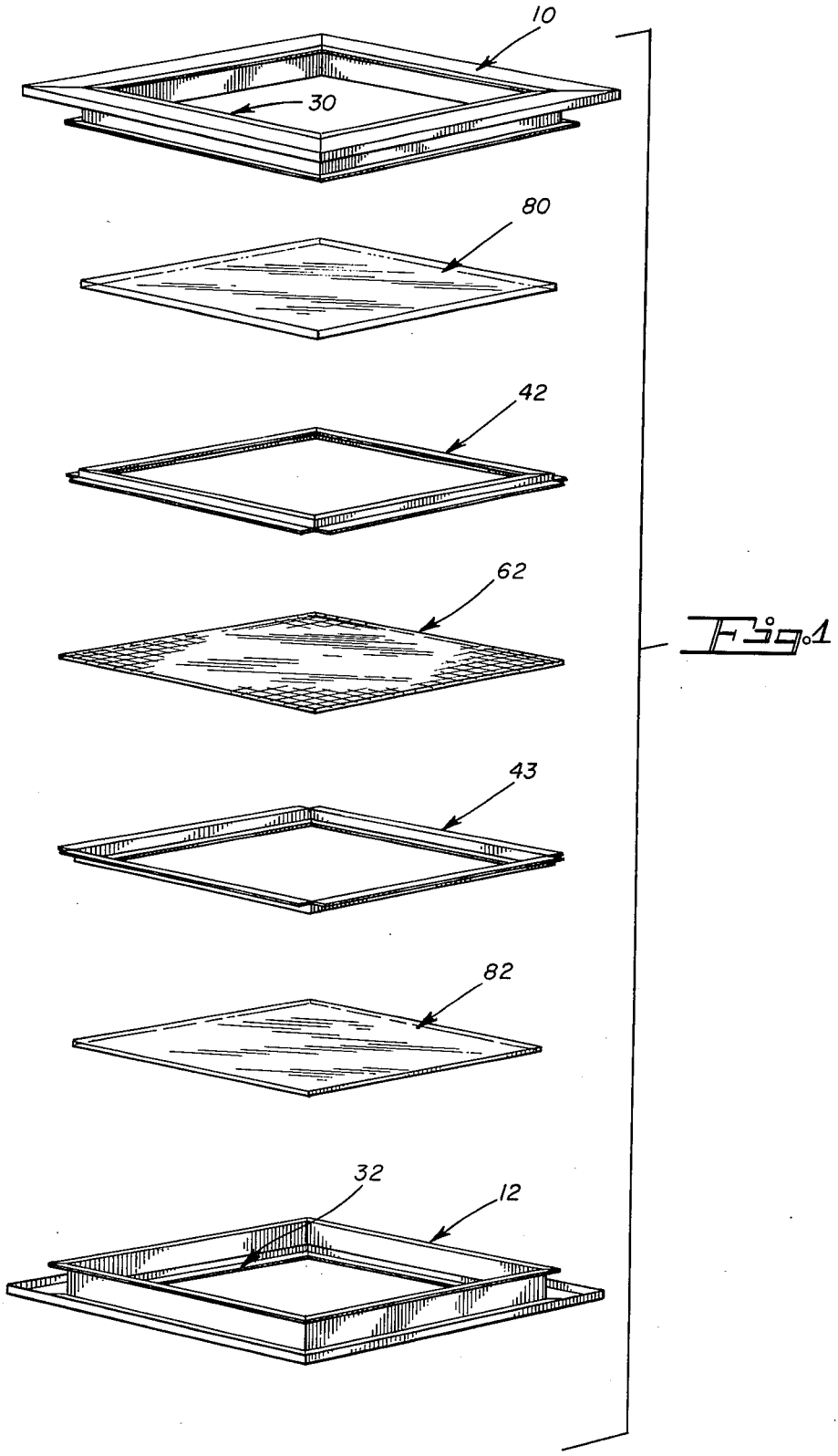
FIG. 1 of the drawing is an exploded perspective view of the window assembly of the present invention.
Figure 2:
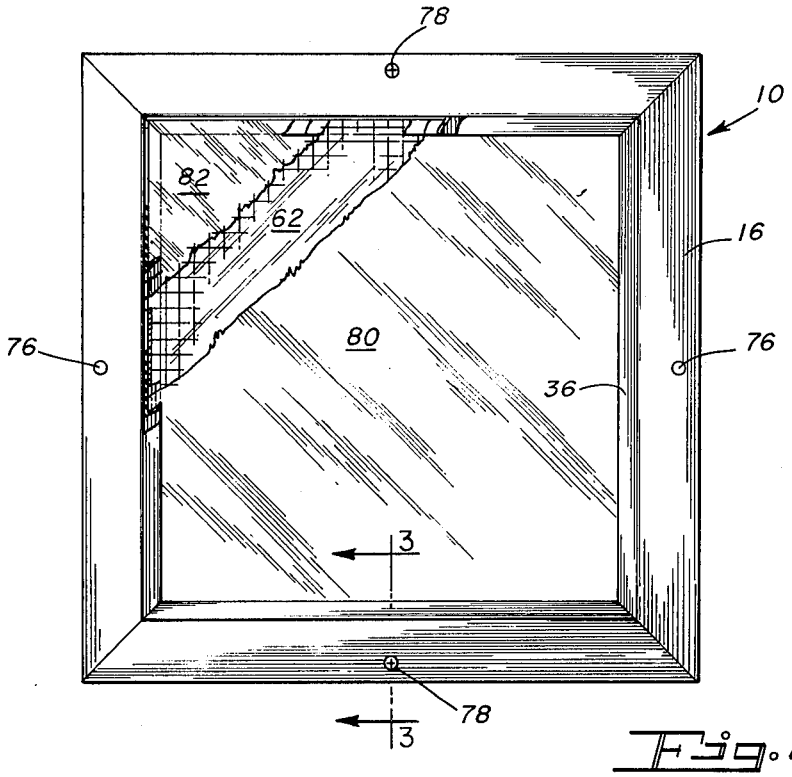
FIG. 2 is a front view of the window assembly partially broken away to show succeeding panes of impact and fire resistant material.
Figure 3:
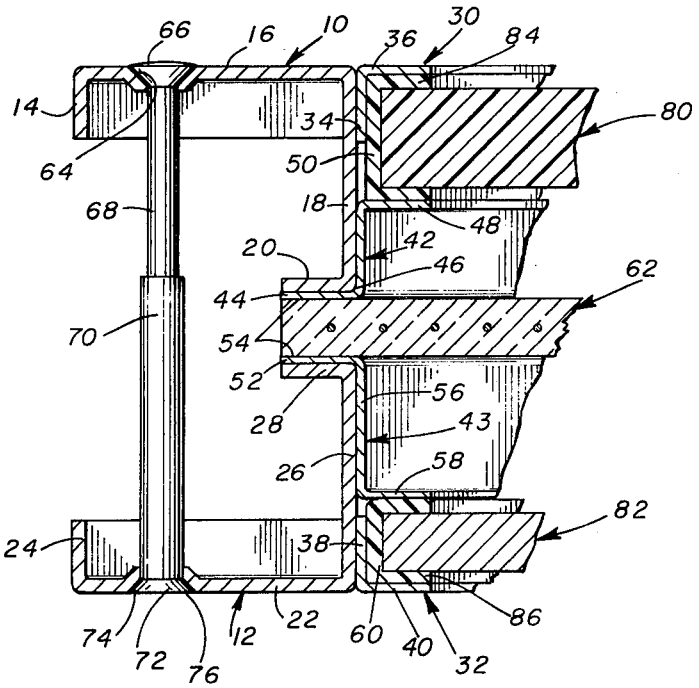
FIG. 3 is an enlarged fragmentary sectional view taken generally as indicated at 3—3 in FIG. 2 and illustrating in greater detail the frame and pane construction of the window assembly.

Referring particularly to FIGS. 1 and 3, it will be observed that a window assembly constructed in accordance with the present invention comprises first and second principal frame members 10 and 12. The frame members 10 and 12 may be constructed of various materials but are preferably of formed sheet metal as shown and said members may also be identical in cross section as illustrated in FIG. 3. That is, each of the frame members 10 and 12 is generally L-shaped in cross section and a small inwardly directed flange is formed at the free end of each leg of the "L". A small flange 14 at an outer or free end portion of a first or face leg 16 of the frame member 10 may engage a wall or door surface in which the window assembly is disposed. A second leg 18 of the frame member 10 which may be referred to as an inner or support leg and which resides within an opening in the wall or door surface has also a small flange identified at 20 at its outer or free end. Similarly, a first or face leg 22 of the frame member 12 has a flange 24 at its free end and an inner or support leg 26 has a flange 28 at its free end.

A first or outer pair of secondary frame members 30, 32 is also illustrated in FIGS. 1 and 3 and the said members may also be of sheet metal construction and identical in cross sectional configuration. As best illustrated in FIG. 3, each of the secondary frame members 30, 32 takes an L-shape when viewed in cross-section and each member has inner and outer legs. An inner leg 34 of the frame member 30 is secured to the inner or support leg 18 of the frame member 10 as by suitable welding so that a perpendicular outer leg 36 of the frame member 30 is disposed in coplanar relationship with the face leg of the frame member 10. The leg 36 projects in a direction opposite from the leg 16 and thus forms a continuation of the outer face portion of the window assembly.

As with the secondary frame member 30, the counterpart frame member 32 has an inner leg 38 and an outer leg 40. The inner leg 38 is welded or otherwise secured to the inner or support leg 26 of the main frame member 12 and the outer leg 40 resides in coplanar relationship with the leg 22 of the member 12. Thus, a continuation of the face of the frame is provided with the leg 40 projecting inwardly and in a direction opposite to that of the leg 22.

The frame assembly also includes first and second inner secondary frame members 42, 43 which may be of sheet metal construction and which are of similar but slightly different cross-sectional configuration. That is, each of the frame members 42, 43 has a generally square Z-shaped cross-sectional configuration and each member has inner and outer arms connected by an intermediate body portin. The body portions of the members, however, differ somewhat in length, a body portion of the member 43 being somewhat longer than that of the member 42.

An inner arm 44 of the member 42 extends adjacent and in parallel relationship with the aforementioned flange 20 on the main frame member 10, the arm 44 being disposed inwardly of the flange 20. An intermediate body portion 46 of the member 42 resides in adjacent and parallel relationship with the leg 18 of the main frame member 10 and extends outwardly from the arm 44. An arm 48 is disposed at an outer end portion of the intermediate body portion 46 and extends toward the center of the frame assembly in parallel spaced relationship with the aforementioned leg 36 of the secondary frame member 30. Thus, it will be apparent that a window pane receiving groove is defined at 50 between the arm 48 and the leg 36 of the member 30. The said groove faces or opens inwardly toward the center of the window frame assembly but is disposed outwardly from the center or intermediate portion of the frame assembly as viewed in FIG. 3 and may hereinafter be referred to as an outer groove.

The frame member 43 has an inner arm 52 which resides adjacent and in parallel relationship with the flange 28 on the leg 26 of the main frame member 12. Thus, with the arm 52 disposed inwardly of the flange 28 it will be apparent that a window pane receiving groove 54 is defined between the arms 44 and 52. The groove may be said to face inwardly toward the center of the window frame assembly and is disposed intermediate the faces of the assembly, thus being referred to as an inner or intermediate groove.

A body portion 56 connected with the arm 52 and extending outwardly therefrom resides in adjacent and parallel relationship with the leg 26 of the frame member 12 and, as mentioned, the said body portion is somewhat longer than the corresponding body portion 46. At an outer end of the body portion 56 an arm 58 is formed integrally with the body portion and extends at right angles thereto and in parallel but spaced relationship with the aforementioned leg 40 of the secondary frame member 32. Thus, a window pane receiving groove is formed at 60 between the arm 58 and the leg 40 and the said groove may be said to face inwardly toward the center of the window frame assembly but is disposed in an outer relationship with respect to the inner or intermediate groove 54. Accordingly, the groove 60 may hereinafter be referred to as an outer window pane receiving groove.

In accordance with the present invention, the window assembly comprises a pane of fire glass which is preferably of the embedded wire mesh type as shown at 62. The pane 62 has marginal portions thereof entered and secured in the inner or intermediate groove 54. Sash putty may be employed between the arms 44, 52 and the pane 62, or as shown, the arms may engage the pane directly. In either event, the assembly is secured in position by means of suitable nut and bolt assemblies extending through a wall or door in which the window assembly is mounted. Four (4) nut-bolt assemblies are shown and each such assembly may be identical with that shown in FIG. 3. A suitable opening 64 in the frame member 10 receives the head 66 of a bolt 68 which is secured in a tubular nut 70, threaded internally and with a head 72 similarly entered in an opening 74 in the frame 12. To provide for tamper-proof construction the tubular bolt members 70,70 preferably have a flat outer or head surface 76 as shown and the bolts 68 have a slot or Philips head construction as shown at 78. Two (2) of the nut-bolt assemblies at the side frame portions of the window assembly have the nuts and bolts extending in one direction and, the opposite two nut-bolt assemblies in the top and bottom portions of the frame have the nut-bolt assemblies arranged with the nuts and bolts in an opposite direction. Thus, two (2) flat and smooth tamper-proof nut heads 76,76 appear on each side of the frame assembly.

Further, in accordance with the present invention, there is at least one outer window pane receiving groove in the frame assembly and, as shown and described above, two (2) such grooves 50,60 are provided each in spaced relationship with the inner or intermediate groove 54. A pane of deflectable impact resistant substantially transparent plastic is provided for each of the grooves 50, 60 when two such grooves are provided and the marginal portions of the panes are entered and secured in the respective grooves. Thus, a pane of deflectable impact resistant plastic 80 has its marginal portions entered in the groove 50 as a pane of similar plastic 82 has its marginal portions entered and secured in the groove 60. Sash putty may be employed for mounting the panes in the grooves as indicated at 84 and 86. Each of the panes 80,82 is preferably of a transparent polycarbonate material.

Dimensions may vary somewhat within the scope of the invention, but it is the presently preferred practice that the fire glass pane 62 be approximately ¼ of an inch in thickness. More importantly, each of the panes 80, 82 must be spaced from the fire glass pane 62 and the relationship between spacing and pane thickness must be predetermined to provide for a desired degree of impact resistance. The plastic panes 80, 82 should be at least ¼ of an inch in thickness and each of the panes should be spaced at least one fourth (¼) of an inch from the fire glass pane 62. Further, the plastic pane 80 is preferably at least three eighths (⅜) of an inch in thickness and a presently desired degree of impact resistance is achieved when the said pane is at least one half (½) of an inch in thickness and is spaced a minimum distance of 0.35 inches from the fire glass pane 62. That is, with the pane 80 approximately one half (½) of an inch in thickness and spaced 0.35 inches from the pane 62, and with a pane assembly of approximately 24 by 24 inches a degree of impact resistance is provided for at a desired level. An inmate in an institution is incapable of breaking the pane by impinging his head thereagainst and the pane is capable even of resisting the impact of a 44 magnum revolver fired at a distance of 4 feet. The pane deflects inwardly under impact and even where engagement may occur between the pane and the fire glass pane 62 the combined strength of the two panes is sufficient to prevent rupture.

In a preferred arrangement in a penal institution, the plastic pane 80 is arranged on the interior of a cell door or the like and the plastic pane 82 is exposed on the exterior side of the door. Thus, a lesser but sufficient degree of impact resistance is provided by the pane 82, which is preferably approximately ¼ of an inch in thickness as stated, but a second important function is nevertheless fulfilled. That is, in the event of fire on one side or the other, the plastic pane exposed to the fire may deteriorate but the fire glass 62 will serve its intended function as a fire stop. The plastic pane on the opposite side of the fire glass will thus retain its integrity and the window assembly will retain its overall fire and impact resistant qualities.

As will be apparent from the foregoing a relatively simple structure has been provided for a window assembly and yet a high degree of fire and impact resistance is achieved in the particular spaced relationship of the window panes. The window assembly can be constructed at economic advantage and is yet found to exhibit a high degree of dependability and durability in service.

I claim:

1. A fire, impact resistant and tamper proof window assembly comprising a multi-part centrally open marginal frame, said frame including part interconnecting means operable with the frame assembled to preclude frame disassembly from one side thereof and said frame having spaced apart first, second and third inwardly facing grooves disposed respectively in outer, inner and outer relationship with the frame assembled, a pane of fire glass with marginal portions secured in said inner groove and extending across the frame central opening, a first pane of deflectable impact resistant substantially transparent plastic with marginal portions secured in one outer groove and extending across said central opening, a second pane of deflectable impact resistant substantially transparent plastic with marginal portions secured in said other outer groove, said plastic panes being at least one fourth (¼) of an inch in thickness and being spaced from said fire glass pane a distance of at least one fourth (¼) of an inch whereby to avoid breakage of said fire glass pane on impact and resulting inward deflection of said plastic panes toward the fire glass, and said plastic panes being formed of a material with high impact resistance characteristics at least similar to that of polycarbonate so that impact on either of said panes may deflect the pane but not rupture the fire glass, and said material having a relatively low melting point such that fire on one side may melt or deform the plastic on said one side but leave the opposite plastic pane intact due to the protection of the fire glass.

2. A fire and impact resistant window assembly as set forth in claim 1 wherein said impact resistant panes are of polycarbonate material.

3. A fire and impact resistant window assembly as set forth in claim 1 wherein at least one of said panes of impact resistant material is at least one half (½) of an inch in thickness.

4. A fire and impact resistant window assembly as set forth in claim 1 wherein said spacing between said fire glass and impact resistant panes is at least 0.35 inches.

* * * * *